United States Patent [19]

Wagner

[11] Patent Number: 4,665,594

[45] Date of Patent: May 19, 1987

[54] MULTI-PURPOSE CLIP

[76] Inventor: Hans R. Wagner, 25 Woodale La., Santa Barbara, Calif. 93103

[21] Appl. No.: 834,195

[22] Filed: Feb. 27, 1986

[51] Int. Cl.[4] ..... A44B 15/00; B42F 1/02

[52] U.S. Cl. ..... 24/546; 24/547; 24/548; 24/3 K; 24/67.9; D19/65

[58] Field of Search ..... 24/546, 547, 548, 545, 24/67.3, 67.9, 3 K; D19/65

[56] References Cited

U.S. PATENT DOCUMENTS

| | | | |
|---|---|---|---|
| D. 53,554 | 7/1919 | Averill | 24/547 |
| D. 75,691 | 7/1928 | Lampl | D19/65 |
| 715,992 | 12/1902 | Cox | 24/548 |
| 743,017 | 11/1903 | McGill | 24/545 |
| 763,303 | 6/1904 | Mayers | 24/547 |
| 1,160,190 | 11/1915 | Murray | 24/547 |
| 2,052,887 | 9/1936 | Lewis | 24/547 |
| 2,502,289 | 3/1950 | Szent-Gyorgyi | 24/547 |
| 2,599,146 | 6/1952 | Wagner et al. | 24/547 |
| 4,107,823 | 8/1978 | Siesto | 24/3 K |
| 4,523,354 | 6/1983 | Tsukamoto | 24/546 |

FOREIGN PATENT DOCUMENTS

| | | | |
|---|---|---|---|
| 1143180 | 2/1963 | Fed. Rep. of Germany | 24/547 |
| 317844 | 9/1902 | France | 24/67.9 |
| 256563 | 1/1928 | Italy | 24/546 |
| 6615445 | 5/1967 | Netherlands | 24/3 K |

*Primary Examiner*—Victor N. Sakran

*Attorney, Agent, or Firm*—Milton S. Gerstein

[57] ABSTRACT

A multi-purpose clip for holding papers, bills, and the like formed a one continuous material, where there is formed an inner heart-shaped loop and an outer heart-shaped loop. The inner loop is provided with a pair of end-portions which overlap and crisscross such that in a first state of the end-portions the two end-portions are biassed toward each other, and in a second state are free from contact with each other. The end-portions provide a torsion effect to aid in the holding of workpieces in the clip, as well as allowing for the clip to be used as a key ring, and the like. The clip may be used such that the workpieces may be inserted and held in three different manners utilizing different portions of the clip as the portions sandwiching therebetween the workpieces.

7 Claims, 7 Drawing Figures

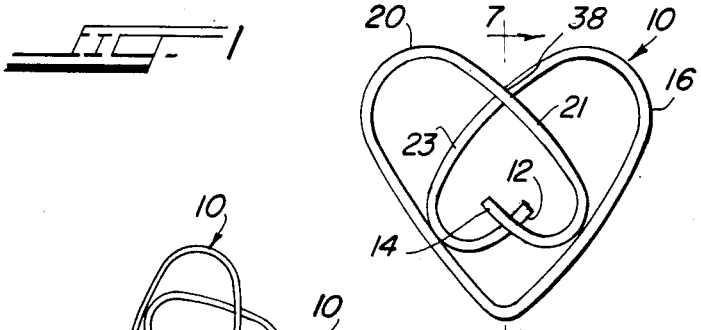
FIG. 1
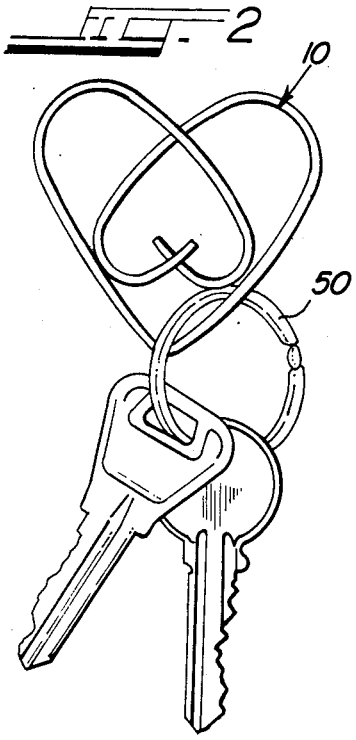
FIG. 2
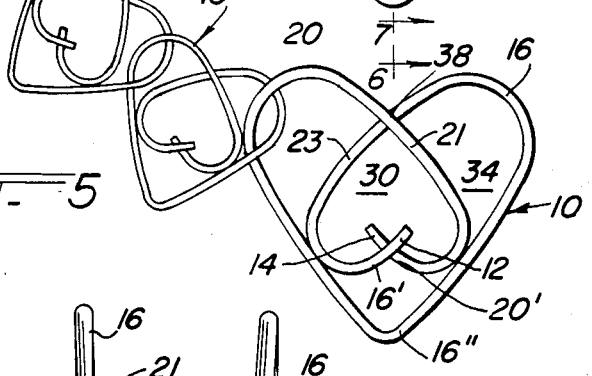
FIG. 5
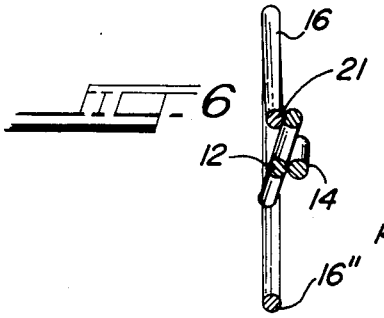
FIG. 6
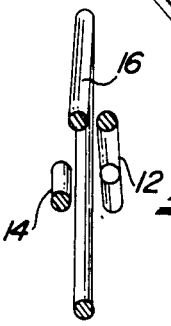
FIG. 7
FIG. 3
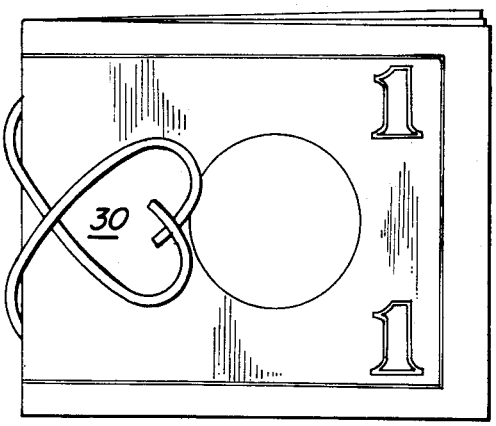
FIG. 4
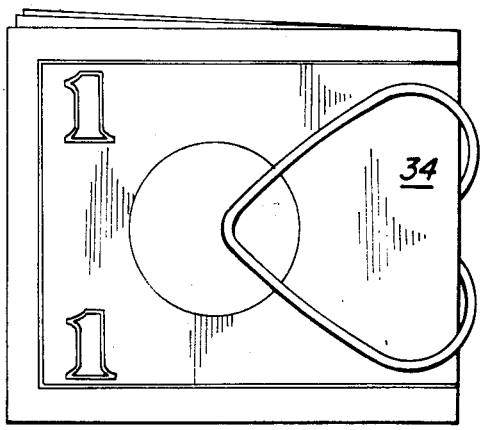

MULTI-PURPOSE CLIP

BACKGROUND OF THE INVENTION

The present invention is directed to an all purpose clip such as for clipping together papers, money, and the like, which may also serve as a key ring. Clips per se are well known and come in many sizes and shapes. One disadvantage of all prior art clips is that the holding force thereof is not the same for all uses, and the holding force thereof is not capable of adjustment. Thus, if the clip be too large for papers desired to be held, a smaller clip must be utilized. Thus, prior art clips do not inherently have any means by which their holding force may be varied to suit the work piece to be held.

SUMMARY OF THE INVENTION

It is therefore, the primary objective to provide a clip that may have its holding force altered such that it may accomodate variously-sized workpieces to be clipped, and hold them in a fast manner.

It is another objective of the present invention to provide such alteration such that in the free state of the clip two different stable states of the clip are provided, each state having its own inherent holding force associated therewith.

It is still another objective of the present invention to provide a clip such that the conversion of one state to the other is easily and readily performed, even while the clip is holding fast a workpiece.

It is yet another objective of the present invention to allow the clip to be used as a key ring that effectively locks in place the key without the threat of accidental removal of the keys thereon, by simply changing over from the first state to the second state thereof.

It is yet another objective of the present invention to allow for the combination of a series of the clips of invention into a decorative design while still serving as a key chain, and the like.

BRIEF DESCRIPTION OF THE DRAWING

The invention will be more readily understood with reference to the accompanying, wherein FIG. 1 is a plan view showing the multi-purpose clip of the present invention;

FIG. 2 is a plan view view of the clip of FIG. 1 showing the clip in its use as a key ring;

FIG. 3 is a side view showing the clip of Figure used as a money clip;

FIG. 4 is a side view similar to FIG. 3 showing the other side of the clip of FIG. 3 when used as a money clip;

FIG. 5 shows a series of clips of FIG. 1 interconnected to form a decorative chain;

FIG. 6 is a cross-sectional view taken along line 6—6 of FIG. 5; and FIG. 7 is a cross-sectional view taken along line 7—7 of FIG. 1.

DETAILED DESCRIPTION OF THE INVENTION

Referring now to the drawings in greater detail, the clip of the present invention is shown in FIG. 2 and is indicated generally by reference numeral 10. The clip 10 includes a first end portion 12 and a second end portion 14 that crisscross as shown in FIG. 2, which end portions 12 and 14 lie in different but parallel planes, such that the end portions 12 and 14 abut against one another with a force. The clip 10 further includes partial loop portion 16 having its first end 16' coincident with an end of the end portion 12. The partial loop portion 16 terminates in a distal end 16''. Another partial loop portion 20 includes a first end coincident with the end 16'' of the loop 16, and another end 20' coincident with an end of the end portion 14.

The clip 10 is made of a spring metal alloy or the like such as spring steel, which imparts resiliency to the clip while also allowing for a force to be created that will allow its use as a clip. As shown in FIG. 6 the end portion 12 lies substantially in the same vertical plane as the portion 21 of the loop 20 such that both the end portion 14 and portion 23 of the loop 16 lie in a plane spaced from the plane containing therein the end portion 12 and portion 21. Thus, in this configuration, the end portions 12 and 14 are urged toward each other. In this configuration, the clip 10 is used to hold papers, to serve as a money clip and the like, by the insertion of the workpiece, such as parallel papers, between the heart shaped loop 30 and the outer heart shaped loop 34. Thus, by viewing FIGS. 3 and 4, it may be seen how papers or bills are firmly held between the inner heart shaped loop 30 and the outer heart shaped loop 34. Referring back to FIG. 6, in the state shown therein, the papers, or the like, are inserted from end 16'' toward the end portions 12 and 14, with a lead end of the papers being sandwiched between the heart shaped loop 30 on one side and the heart shaped loop 34 on the other side. This is accomplished by moving the loop portions 21 and 23 outwardly from the remainder of the loops 16 and 20, such movement having its fulcrum at the juncture 38 where the portions 21 and 23 intersect. This provides the holding force for the clip, since the bending about the fulcrum 38 tends to cause the clip to return to its neutral, free state shown in FIG. 6.

Referring now to FIG. 1, the second state of the clip 10 is shown in which the end portions 12 and 14 no longer abut one another, since the loops 16 and 20 form a substantially continuous spiral-like configuration. In this second state of the clip, since the end portion 12 is no longer on the opposite side of the fulcrum 38 as the portion 23, the end portions 12 and 14 are not forced toward each other. In this second state of the clip, which is designed for bulkier work pieces, the work piece may be inserted in the manner as described above for the state shown in FIG. 6. Further, since the end pieces 12 and 14 no longer are forced toward each other the clip may also sandwich therebetween work pieces by inserting the work piece between the loop portion 16 and the loop portion 20. In this instance, the work piece is inserted by bringing it toward the fulcrum 38 and sliding the work piece toward the end portions 12 and 14. Thus, in this second state of the clip, two possible ways of holding may be achieved, each providing a different biassing force, which may be utilized for holding different thicknesses of work pieces.

The clip 10 when in the first state shown in FIG. 6 may also be used as a key ring, as shown in FIG. 2. To insert a key or key ring 50 the clip 10 is arranged in its second state shown in FIG. 7. The second state, since it is substantially spiral-like in form allows quick and easy sliding of the key or key ring on to the clip via one of the end portions 12 and 14. The key or key ring is then slid along the loop, after which the clip 10 is brought into its first state by interlocking the end portions 12 and 14, to thereby effectively prevent the escape of the key or key ring, unless the clip is returned to its second state thereof.

FIG. 5 also shows how the clip 10 may be interconnected with a plurality of like clips 10 to form a decorative chain, or the like, other for wearing or display. It is noted that in the first state of the clip 10 shown in FIGS. 5 and 6, the end portions 12 and 14 are urged toward each other also by the force provided by the torsion created in each of the loop portions 23 and 21, respectively, which torsion helps to lock in place the end portions with respect to each other. Thus, the state from that shown in FIG. 6 to that shown in FIG. 7 is achieved by removing this torsion effect by moving the loop portion 23 outwardly until the end portion 12 clears the end portion 14.

It is also to be noted that the clip 10 may come in any size and dimension. For example, the clip 10 may have a size as any paper clip or paper binder, and also be provided in very large size such that it may serve as a wall hanger element. In this very large sized embodiment, the clip 10 would be hung from a wall or the like directly at the juncture 16" by a nail or the like. Thereafter, all sorts of pamphlets, papers, sheets, notes, and the like may be inserted in the clip in the same manner described above with reference to the state shown in FIG. 6. Since the clip would be hanging upside-down in relationship to the orientation shown in FIGS. 1 and 5, none of pieces held therein would fall to the floor therebelow since the outer loops 16 and 20 would prevent it, while at the same time the force between the inner heart 30 and outer heart 34 would grip the pieces therebetween.

While a specific embodiment of the invention has been shown and described, it is to be understood that numerous changes and modifications may be made therein without departing from the scope and spirit of the invention as set out in the appended claims.

What is claimed:

1. A clip for holding articles such as paper, and the like, and for serving as a storage ring, comprising:

a first partial loop portion having at one end thereof a first end portion;

a second partial loop portion having at one end a second end portion;

said first and second partial loop portions forming one integral, continuous element having restorative properties so as to provide a restorative force if one part thereof is moved relative to another part thereof;

said first and second end portions lying in different planes, said first and second end portions assuming one of two possible states thereof, a first state being constituted by abutting relationship such that said end portions crisscross and are urged toward each other by said restorative force, a second state thereof being constituted by crisscrossing of said end portions without a tendency of urging said end portions into abutting relationship;

said first and second end portions lying substantially within the interior of the clip as defined by the elongation of said first and second partial loop portions wherein said first and second loop portions define thereby a first substanially outer heart-shaped like perimeter, and a second substanially inner heart-shaped-like perimeter, said first and second end portions being part of said inner heart-shaped-like perimeter and defined at the dimple thereof.

2. the clip according to claim 1, wherein said first loop portion and said second loop portion have a common end forming a vertex thereat;

said first and second end portions crisscrossing to define thereby a center of crossing; and said first and second loop portions also crisscrossing at a portion of each lying in substantially the same plane as said center of crossing and said vertex.

3. The clip according to claim 2, wherein during said first state of said clip, said first end portion lies in a plane spaced from and parallel to a plane containing therein said portion of said first loop portion defining the center of crossing of said first and second loop portions.

4. the clip according to claim 2, wherein during said second state of said clip, said first end portion lies within substantially the same plane as said portion of said first loop portion constituting the center of crossing of said first and second loop portions.

5. The clip according to claim 3, wherein during said first state of said clip said second end of said second loop portion lies in a plane spaced from and parallel to a plane containing therein said portion of said second loop portion defining the center of crossing of said first and second loop portions.

6. The clip according to claim 5, wherein said second end portion lies substantially within the same plane as said portion of said first loop portion defining the center of crossing of said first and second loop portion.

7. The clip according to claim 6, wherein said first end portion lies substantially within the same plane as said portion of said second loop portion constituting the center of crossing of said first and second loop portion.

* * * * *